United States Patent [19]

Asahara

[11] 4,036,282

[45] July 19, 1977

[54] PROCESS OF INGOT CASTING

[75] Inventor: Hidetoshi Asahara, Kobe, Japan

[73] Assignee: Foseco International Limited, Brimingham, England

[21] Appl. No.: 609,805

[22] Filed: Sept. 2, 1975

[30] Foreign Application Priority Data

Sept. 4, 1974 Japan ..... 49-101603

[51] Int. Cl.[2] ..... B22D 27/00

[52] U.S. Cl. ..... 164/123

[58] Field of Search ..... 164/123; 106/38.22, 106/38.23, 38.27

[56] References Cited

U.S. PATENT DOCUMENTS

| | | | |
|---|---|---|---|
| 2,462,256 | 2/1949 | Charman et al. | 164/123 X |
| 3,672,918 | 6/1972 | Rocher et al. | 106/38.27 X |
| 3,876,420 | 4/1975 | Phoenix et al. | 164/123 X |

FOREIGN PATENT DOCUMENTS

| | | |
|---|---|---|
| 16,332 | 4/1974 | Japan |
| 1,298,831 | 12/1972 | United Kingdom |

*Primary Examiner*—Gil Weidenfeld

*Attorney, Agent, or Firm*—Cushman, Darby & Cushman

[57] ABSTRACT

The surface quality of ingots may be improved by bottom-pouring molten metal into an ingot mould wherein there is located in the ingot mould, prior to the commencement of pouring, a multi-layered board having a first layer which is a preformed slab comprising an anti-piping composition including an exothermic material and a second layer adjacent the first layer which is a preformed slab comprising a fluxing agent, a fibrous material and a binder, the second layer having a central cavity therein filled with a preformed refractory slab comprising a refractory material, a fibrous material and a binder, the slabs being arranged such that the refractory slab is enclosed within the board, and the board being located in the mould with the first layer uppermost. The board acts as both a mould additive and as an anti-piping compound.

13 Claims, 1 Drawing Figure

PROCESS OF INGOT CASTING

Figure 1:
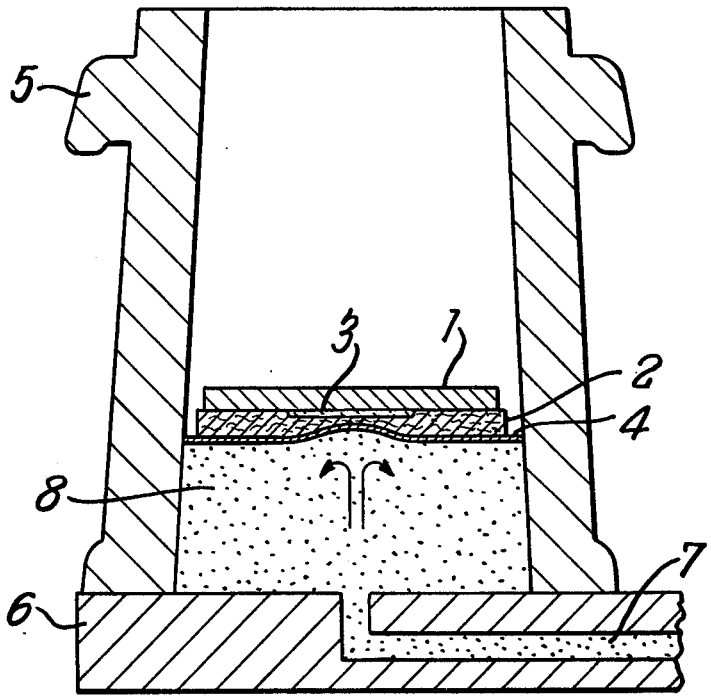

The present invention relates to the casting of molten metals to form ingots. While the method be described may be used to advantage in the casting of various metals, its principal use is in the casting of steel ingots, and the following description is accordingly primarily directed to that use.

Ingot moulds may be charged with molten metal either by teeming the metal into the top of the ingot mould or by filling the ingot mould with molten metal from the base. The present invention is directed to this latter case, so-called bottom pouring.

When molten steel is bottom-poured into an ingot mould there is a tendency for the surface of the molten metal to oxidise in contact with air and to form an oxide skin thereon. In addition, during solidification, the ingot tends to weld itself to the mould walls, and subsequent stripping from the mould, if not rendered impossible, may result in damage to the mould walls and/or defects in the ingot surface.

In order to prevent oxidation and to improve ingot surface, mould additives can be applied to the molten metal surface during pouring. Examples of mould additives which have been used are those comprising fluxing agents such as fly-ash, sodium carbonate, blast furnace slag, wollastonite, fluorspar and cryolite, and in addition, coke, charcoal and carbon black. So far these mould additives have generally been sued as powders wrapped in paper bags, hung in the bottom part of the mould on a wire or placed on the bottom of the mould. However, this has the disadvantage that after the paper bags have been decomposed by the heat of molten steel, particles of mould additive can be entrapped in the molten steel and the resultant ingots can contain non-metallic inclusions. In addition, powder materials, by virtue of being very fine, can generate copious dust and thereby contaminate the workshop.

In order to overcome these disadvantages, it has been proposed to add fibrous materials and binders to the mould additives and to use them in board form. For instance, in British Patent Specification No. 1,298,831, there is described a process for the production of an ingot in which a bonded mat comprising refractory fibrous material and at least one of soda ash and fly-ash is employed. In addition, in Japanese Patent Publication No. 16332/74, there is described a method involving locating a board with a thicker central portion on the bottom of a mould, the board being a mixture of organic fibrous materials, fly-ash, carbonaceous material, fluoride, nitrate and thermosetting resin in a specific ratio.

By using board type mould additives entrapment of particles of mould additives in molten steel and dust generation can be prevented. However, in the case of bottom pouring, molten steel enters upwards from the bottom of the mould so that the central portion of the board tends to melt rapidly, and this can result in the opening up of a hole at the centre of the board or even in break-up of the board. If the board is holed or broken up, molten steel can be oxidised in contact with air, so the objective of preventing oxidation is not achieved. This additional problem is not solved completely even by increasing the thickness of the central portion of the board as mentioned in the above patent publication No. 16332/74.

In addition, in order to prevent pipe formation when molten steel poured in an ingot mould solidifies, anti-piping compounds can be applied to the molten steel surface. In the case of anti-piping compounds, they also can be used in board form in order to prevent generation of fume and dust. The anti-piping compounds in board form may be applied after teeming, but particularly in the case of bottom pouring it is convenient to suspend the anti-piping board in the top part of the mould prior to pouring.

Thus, generally, mould additives and anti-piping compounds have been separately positioned on the bottom part and in the top part of ingot moulds respectively. Setting work therefore, could be troublesome.

A method of placing a combined body of formed anti-piping compounds and mould additives in ingot moulds is proposed in Belgian Patent Specification No. 640,840. In this method, the lower portion of the body comprises fly-ash or slag and the upper portion comprises highly exothermic material. However, it is difficult to cover the molten steel surface entirely due to the cylindrical shape of the disclosed body. Accordingly, the disclosed method is not suitable for use in ingot casting by bottom pouring.

From the above it can be seen that there is a need to provide a process in which it is possible to prevent oxidation of a molten steel surface when using a multi-layered board comprising a mould additive and an anti-piping compound located in the ingot mould separately and to simplify setting them in the mould. Using a mould additive and an anti-piping compound in multi-layered board form, it is possible to prevent the molten steel surface becoming exposed to air to some extent through the use of the upper anti-piping layer, even if the mould additive board develops a hole or breaks up. However, in the case of merely putting the preformed anti-piping compound on the pre-formed mould additive, as mentioned above, the mould additive can melt earlier at the centre than at the outside, the anti-piping compound can ignite at too early a stage in the pouring and a satisfactory feeding effect cannot be obtained. Therefore, it is necessary to adjust the time of ignition so that the anti-piping compound ignites at the right time.

This invention aims at adjusting the time of ignition for the anti-piping compound by interposing a layer of refractory material between the mould additive and the anti-piping compound.

Accordingly, the present invention provides a process for producing an ingot from a molten metal by bottom-pouring molten metal into an ingot mould wherein there is located in the ingot mould, prior to the commencement of pouring, a multi-layered board having a first layer which is a pre-formed slab comprising an anti-piping composition including an exothermic material and a second layer adjacent the first layer which is a pre-formed slab comprising a fluxing agent, a fibrous material and a binder, the second layer having a central cavity therein filled with a preformed refractory slab comprising a refractory material, a fibrous material and a binder, the slabs being arranged such that the refractory slab is enclosed within the board, and the board being located in the mould with the first layer uppermost.

The first layer of the multi-layer board used in the process of this invention may comprise any of the well known anti-piping formulations. For example, the first layer may be a slab made of a composition comprising an easily oxidisable metal such as aluminum or calcium, a refractory material, a fibrous material, a binder, and optionally an oxidising agent.

Typical commercially available anti-piping formulations are supplied either as a powder or preformed to a particular shape. However, since in general shaped formulations are inferior in heat-insulating properties compared with powdery ones, in order to improve heat insulation after burning the shaped anti-piping formulations preferably include ingredients which enable them to expand during burning, and become porous. For this purpose, it is desirable to incorporate a material which expands on heating, for example, vermiculite, perlite, obsidian or acid-treated expandable graphite. Among these materials, acid-treated graphite is the most preferred. An anti-piping formulation containing such acid-treated expandable graphite is described, for example in Japanese patennt publication, Laid Open No. 16627/74.

The second layer of the multi-layer board used in the process of the present invention is made up of a composition containing a fluxing agent, a fibrous material and a binder. For this purpose suitable fluxing agents are, for example, fly-ash, sodium carbonate, blast furnace slag, wollastonite, cryolite, fluorspar and mixtures thereof; suitable fibrous materials include organic and/or inorganic fibrous materials such as paper pulp, asbestos and slag-wool used alone or in admixture; and suitable binders are, for example, phenol-formaldehyde resins, starches, clays and colloidal silica sols, again either used alone or in admixture. In addition, materials which expand on heating, for example, vermiculite, perlite, obsidian and acid-treated graphite may be included in the second layer. The addition of these materials may be desirable because the mould additive layer can then expand to provide a good heat-insulating layer.

In addition, the multi-layer board includes a refractory heat-insulating material in the central cavity of the second layer on the side not directly touching molten metal, and this comprises a refractory material, a fibrous material and a binder. For this purpose suitable refractory materials include silica sand, alumina, magnesia, chamotte, and mixture thereof; suitable fibrous materials include organic and/or inorganic fibrous materials such as paper pulp, asbestos, slag-wool and mixtures thereof; and suitable binders include phenol-formaldehyde resins, starches, clays, colloidal silica sols, and mixtures thereof.

Where the first layer of the multi-layer board used in the process of this invention is made of a composition including a refractory material, a fibrous material and/or a binder, these may be as described above for the second layer of the multi-layer board and/or the preformed refractory slab.

The above three kinds of slabs or boards constituting the multi-layered board for use in this invention may be formed separately and then bonded together. For example, they may be stuck together with an adhesive, nailed together or bound together with wire. Alternatively they may be formed together as a single body.

In the multi-layered board the refractory slab is preferably thinner than the second layer of the board. Apart from that the thickness and size of the board are decided according to the size of ingot to be cast, casting speed, and other process factors as will be clearly understood by those skilled in the art of ingot casting.

Figure 2:
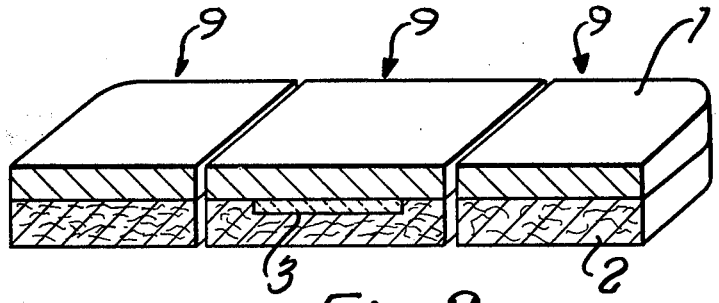

The process of the present invention will now be described by way of example with reference to the accompanying drawings in which:

FIG. 1 shows in diagrammatic form a longitudinal section through an ingot mould when used in the process of the invention, and FIG. 2 is a perspective view, partially cut away, of one form of multi-layered board for use in the process of the invention.

Referring to FIG. 1, a multi-layered board comprises a first layer 1 of an anti-piping composition, a second layer 2 of a mould additive comprising a fluxing agent, a fibrous material and a binder, and a refractory slab or board 3 between the two layers. The slabs or boards of layers 1 and 2 and the refractory slab or board 3 are formed separately, the board of layer 2 with a cavity at the centre of its upper side in which slab or board 3 is inserted. The board of layer 1 is then placed on the board of layer 2 over the cavity and the boards adhered together as a single body by means of an adhesive.

In use, this multi-layered board is placed on base plate 6 of ingot mould 5 prior to pouring, with layer 2 downward and adjacent the base plate. Next molten steel 8 is bottom-poured through runner 7 in base plate 6. Then layer 2 melts gradually and forms a molten covering material layer 4, which covers the molten steel surface and cuts it off from the air. When molten steel 8 is poured, the central portion of layer 2 against which the stream of molten steel impinges, melts most rapidly and becomes thinner. However, board 3 at the centre of the upper side of layer 2 does not melt due to the heat of the molten metal. Therefore, even if the centre of layer 2 melts and an opening is formed, the molten steel surface is still covered by layer 1 and board 3 and is not exposed to air. In addition, if layer 2 is cracked, layer 1 and board 3 prevent its break-up and any consequent oxidation of the molten steel surface is prevented.

In addition, whether or not the central portion of layer 2 melts rapidly board 3 can restrain ignition of layer 1 until layer 2 is almost completely destroyed. Accordingly, by suitably selecting the thickness and the size of board 3, it is possible to adjust the exothermic reaction of layer 1 so that this reaction takes place at the time when the feeding effect is most required.

Referring to FIG. 2, this shows a multi-layered board which can be used in casting large slab ingots. In use, such slab ingot moulds, the multi-layered board must also be of large size and consequently heavy. In this case a multi-layered board in the form of a single body may be inconvenient both to form and to use. It is, therefore, convenient to subdivide the board into a plurality of sub-units 9 each comprising at least said first and second layers 1 and 2 as shown in FIG. 2.

FIG. 1 shows the shape of a multi-layered board for use in big-end-down moulds. Preferably, the dimensions of the upper layer 1 are slightly smaller than those of layer 2, but the dimensions of the two may be the same. In the case of use in big-end-up moulds, the relation between the two may be reversed.

I claim as my invention:

1. In a process for producing an ingot from a molten metal by bottom pouring molten metal into an ingot mould, the improvement which comprises locating in the ingot mould, prior to the commencement of pouring, a multi-layered board having a first layer which is a preformed slab comprising an anti-piping composition including an exothermic material and a second layer adjacent the first layer which is a preformed slab comprising a fluxing agent, a fibrous material and a binder, the second layer having a central cavity therein filled with a preformed refractory slab comprising a refractory material, a fibrous material and a binder, the slabs being arranged such that the refractory slab is enclosed within the board, and the board being located in the mould with the first layer uppermost.

2. The process of claim 1, wherein the first layer of the multi-layered board comprises an easily oxidisable metal, a refractory material, an oxidising agent, a fibrous material and a binder.

3. The process of claim 2, wherein the easily oxidisable metal is selected from the class consisting of aluminum and calcium.

4. The process of claim 1 wherein at least one of the first and second layers of the multi-layered board includes a material which expands on heating.

5. The process of claim 4, wherein the material which expands on heating is selected from the class consisting of vermiculite, perlite, obsidian and acid-treated graphite.

6. The process of claim 1, wherein the second layer of the multi-layered board includes at least one fluxing agent selected from the class consisting of fly ash, sodium carbonate, blast furnace slag, wollastonite, cryolite and fluorspar.

7. The process of claim 1, wherein at least one of the first and the second layers of the multi-layered board and of the preformed refractory slab includes at least one fibrous material selected from the class consisting of paper pulp, asbestos and slag-wool.

8. The process of claim 1, wherein at least one of the first and the second layers of the multi-layered board and of the preformed refractory slab includes at least one binder selected from the class consisting of phenol formaldehyde resins, starchs, clays, and colloidal silica sols.

9. The process of claim 1, wherein the first layer of the multi-layer board and or the preformed refractory slab includes at least one refractory material selected from the class consisting of silica sand, alumina, magnesia and chamotte.

10. The process of claim 1 wherein the multi-layered board is sub-divided into a plurality of sub-units.

11. The process of claim 1, wherein the metal is steel.

12. The process of claim 1, wherein the multi-layered board comprises slabs which have been formed together as a single body.

13. The process of claim 1, wherein the refractory slab has a thickness less than the thickness of the second layer of the multi-layered board.

* * * * *